United States Patent [19]

Simpson

[11] Patent Number: 4,578,903

[45] Date of Patent: Apr. 1, 1986

[54] CORNER LOCKING AND ASSOCIATED PIVOT MEANS FOR EXTRUDED PLASTIC SASH WINDOWS

[75] Inventor: Harold Simpson, Hazelcrest, Ill.

[73] Assignee: Ashland Products Company, Chicago, Ill.

[21] Appl. No.: 602,382

[22] Filed: Apr. 20, 1984

[51] Int. Cl.[4] ..... E05D 15/22

[52] U.S. Cl. ..... 49/175; 49/180; 49/450

[58] Field of Search ..... 49/180, 181, 175, 174, 49/176, 394, 450

[56] References Cited

U.S. PATENT DOCUMENTS

| | | | |
|---|---|---|---|
| 2,605,870 | 8/1952 | Hansen | 49/450 X |
| 3,377,747 | 4/1968 | Donkin | 49/450 X |
| 4,087,941 | 5/1978 | Wolfe | 49/450 |
| 4,144,674 | 3/1979 | Dovman | 49/181 X |
| 4,324,072 | 4/1982 | Sterner, Jr. | 49/176 X |
| 4,475,311 | 10/1984 | Gibson | 49/176 |

*Primary Examiner*—Philip C. Kannan

*Attorney, Agent, or Firm*—Silverman, Cass & Singer

[57] ABSTRACT

A window sash of a double-hung window assembly has framing members formed of extruded plastic material of one configuration providing a hollow formation extending therethrough and opening to the ends thereof. Support and connector members are installed internally of the framing members to form and rigidify the corner miter-joints therebetween. The support and connector members include internal latch means for maintaining the sash vertical and internal pivot means for pivoting the sash inwardly when the latch means is released.

34 Claims, 25 Drawing Figures

FIG. 4
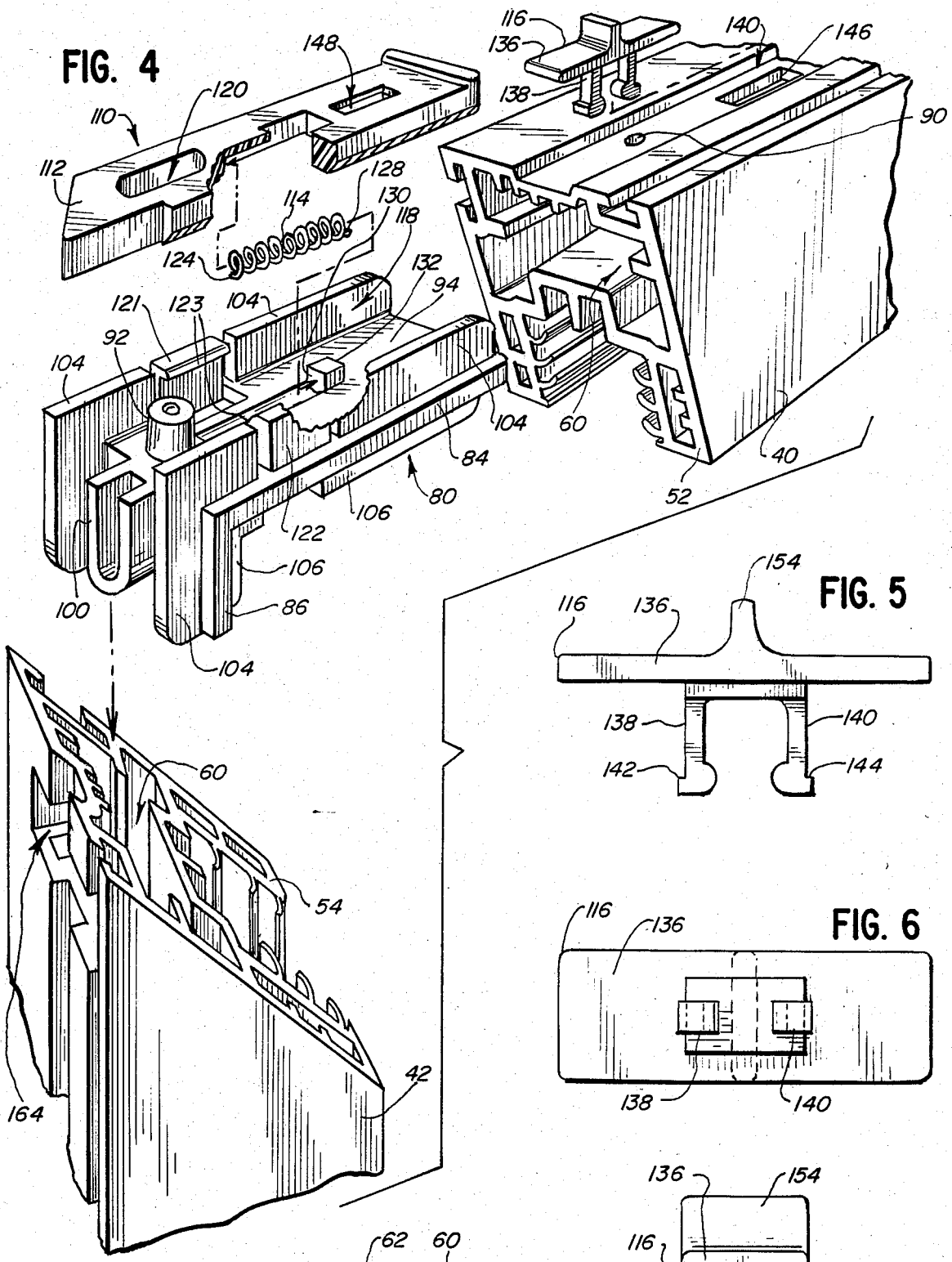
FIG. 5
FIG. 6
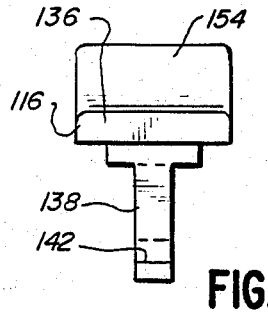
FIG. 7
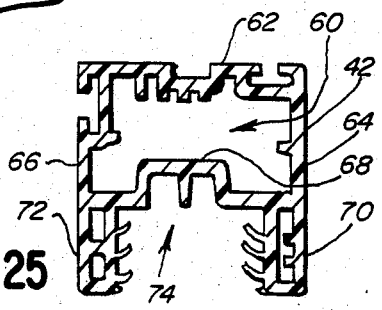
FIG. 25

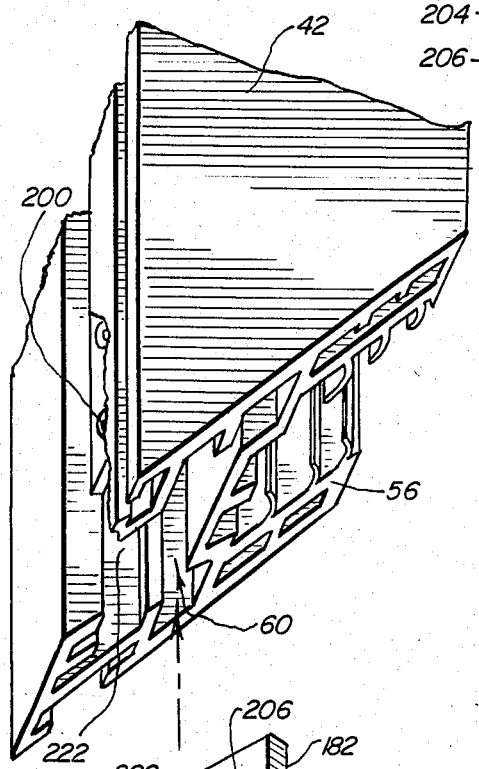
FIG. 16
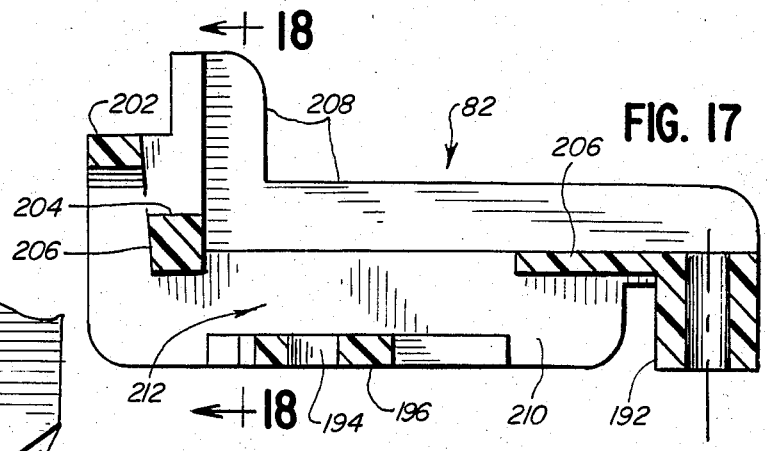
FIG. 17
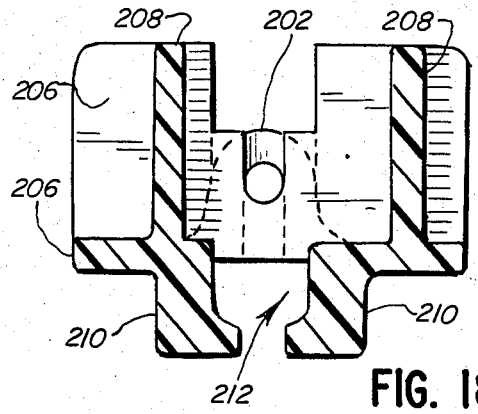
FIG. 18
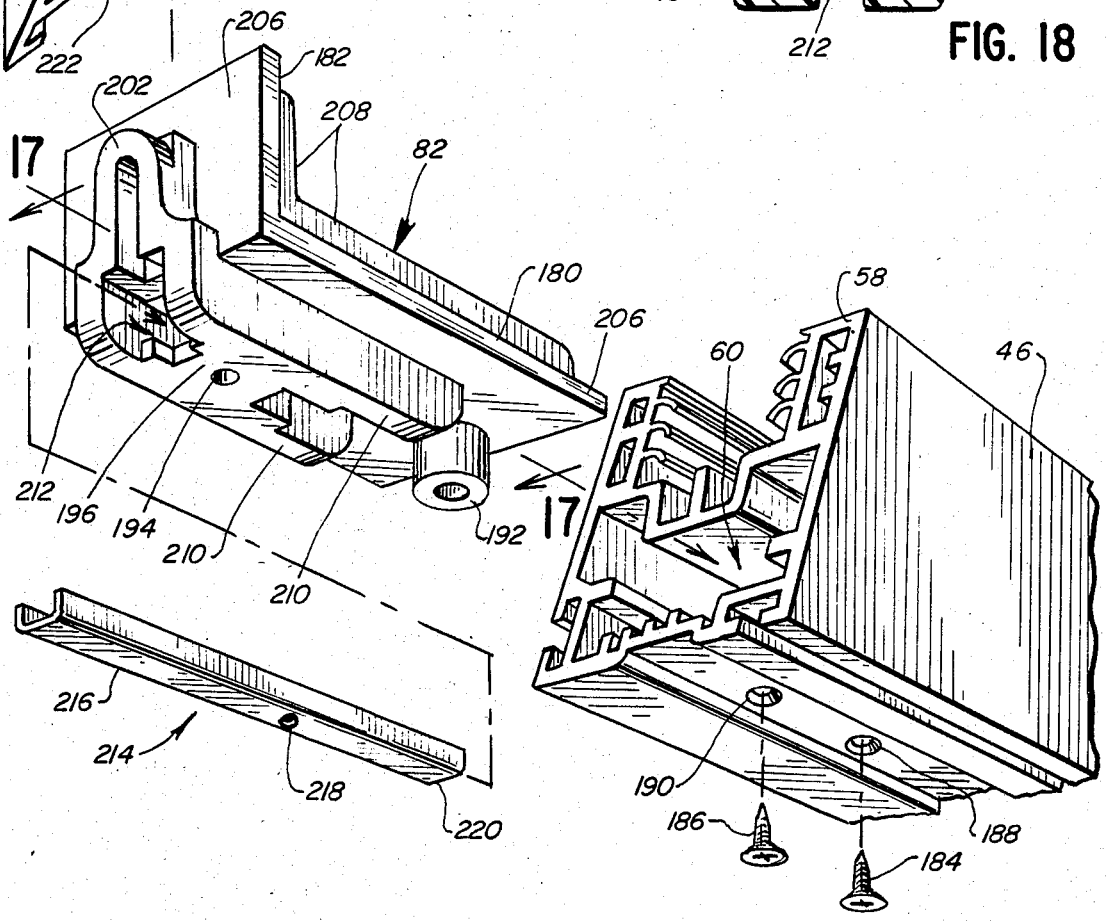

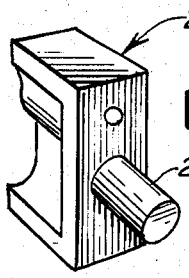
FIG. 22
FIG. 19
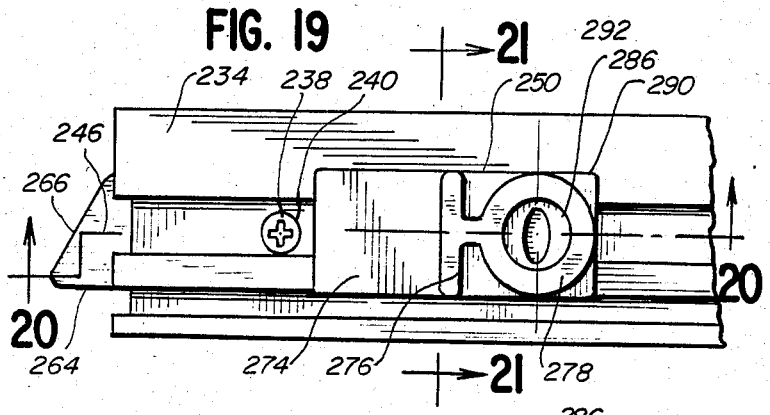
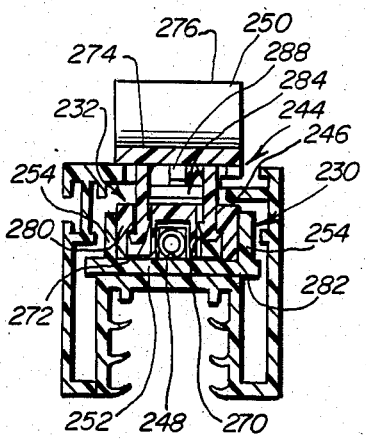
FIG. 21
FIG. 20
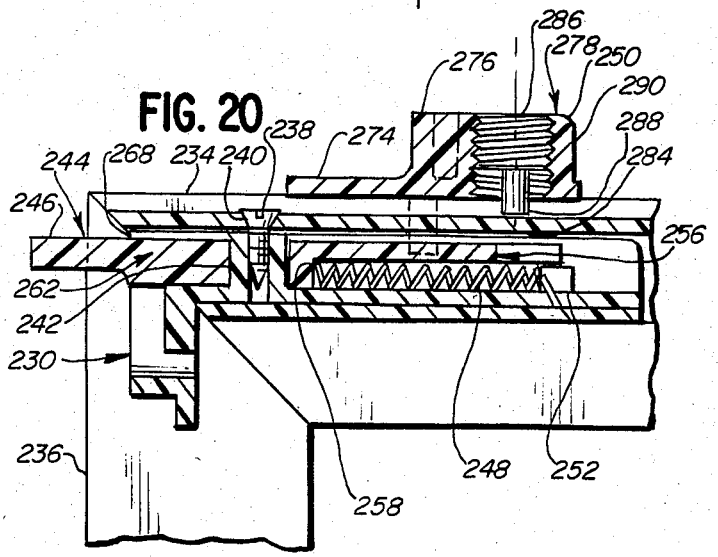
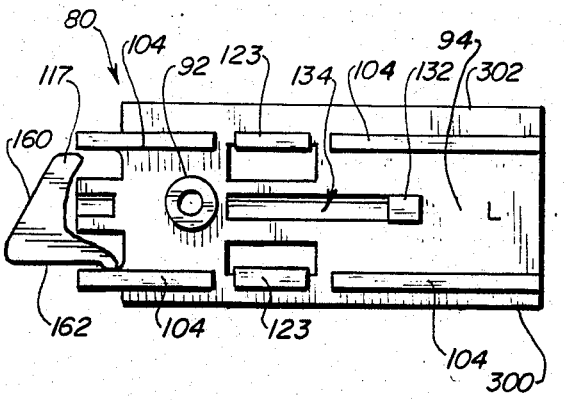
FIG. 23
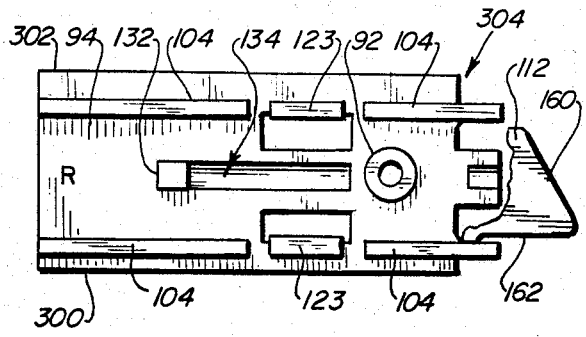
FIG. 24

CORNER LOCKING AND ASSOCIATED PIVOT MEANS FOR EXTRUDED PLASTIC SASH WINDOWS

BACKGROUND OF THE INVENTION

This invention relates generally to a double-hung window assembly having pivotal sashes and more particularly, to an improved sash constructed from extruded plastic framing members having novel latching and pivotal means associated therewith at the miter joints of the sash.

Known double-hung window assemblies provide for inward tilting or pivoting of the two sashes by means of rotating members at the bottom ends of the sash balance mechanisms located in the jambs of the master window frame. Each sash has a pair of pivot pins or the like connected to the rotating member for rotation of the sash around a lower pivotal axis. Alternatively, the sash balance mechanisms provide pins received at the lower margin of the sashes. Normal vertical reciprocal movement of the sashes is maintained by latch mechanisms disposed at the top margins of the sashes. The latch mechanisms usually include some manner of latch bolts that can slide along guide rails extending vertically of the master frame jambs. Releasing the latch mechanisms permits the sash to be pivoted inwardly for cleaning and/or servicing of the window glass pane.

Recently, such window assemblies and sashes have been formed of extruded synthetic plastic in order to reduce manufacturing and maintenance costs. In U.S. Pat. No. 4,144,674, extruded plastic members of one, uniform, cross-sectional configuration are fabricated to form the master frame while extruded plastic members of another, uniform cross-sectional configuration are fabricated to form the frame of each sash. Each sash has two latching mechanisms fastened onto the top surface of the header and two pivot pins fastened onto the bottom surface of the base,. The sash frames have miter-jointed corners. Hollow configurations of the sash framing members function to provide insulation against heat loss through the sash frame.

Fabrication of such a frame occurs by inserting the four frame members in a jig and clamping them together until the adhesive at the miter-joints sets. This requires waiting time for setting of the adhesive; and further perfectly joined corners are a very difficult and often inconsisent achievement. As often ocurs, the extruded members are slightly warped or mitered imperfectly so that mating end edges that are intended to abut fail to do so. The result is non-mating miter joint end edges that are readily discernable because of the slivers of light that can pass through the joint in a direction normal to the plane of the sash. Such slivers of light leakage signal air and heat leakage rendering the particular sash undesirable for use in a home or office where heating costs are important.

Further, the completion of such a sash requires the addition of the latch mechanisms and pivot pins, including the proper location of the pivot pins for proper insertion in the sash balance mechanisms, but non-interference with the master frame jambs.

Heretofore, the latch mechanisms have been applied external of the sash header with a suitable covering or guiding plate, or if internal, in a groove of the header, with a similar covering or guiding plate to close the groove. These covers and/or grooves add to the cost of the sash.

It is thus desirable to reduce the cost of utilizing such latch mechanisms while eliminating the light leakage at miter joints and positively locating the pivot pins. It will be appreciated that manufacture and assembly of such sashes and window assemblies must be economical and of good consistent quality in order to be competitive. The large number of such window and sash structures used in the building industry requires such economical considerations.

SUMMARY OF THE INVENTION

The invention comprises a sash frame adapted to be installed in a double hung window assembly, the sash frame being formed of hollow, extruded plastic framing members with novel support and connector members installed internally of the framing members to form and maintain the miter-joints at the corners of the sash frame. Two of the support and connector members of each sash include latch means also installed internally in the framing members for maintaining the sash in a normal vertical position and reciprocal in the window assembly. Two additional support and connection members are provided for each sash which include pivot pins internal of the framing members properly located for engagement with the sash balance mechanism of a window assembly. The support and connector members facilitate fabrication of the sash frame, block light leakage through imperfect miter-joints, simplify the latch means and positively locate the pivot pins.

The typical double-hung window assembly includes a master frame having a top header, two side jambs and a lower sill. The jambs have vertically extending slots or grooves for receiving therein sash balance mechanisms, there being two such mechanisms in each jamb, one for each sash. Vertically extending formations of each jamb, such as the edges of the slots or grooves, provide guide rails against and along which the sash latch mechanisms slide or glide during normal, vertical, reciprocal movement of the sashes in the master frame. The bottom ends of the sash balance mechanisms have rotatable members for receiving the pivot pins of the sashes.

Each sash comprises a rectangular frame having a top header, two side stiles and a bottom base. The sash frame mounts desired glazing. The header, stiles and base are extruded from synthetic plastic material to a uniform cross-sectional configuration defined by a continuous hollow formation therethrough. The hollow formation opens to opposite ends of the header, stiles and base and the ends thereof are mitered to mate with the adjacent extremities of the framing members, i.e. the header, stiles and base. The stiles have outer side walls through which two passageways are formed, each contiguous an end of the stile, so that the passageways open outwardly of the sash.

Each sash further comprises four combination support and connector members engaged in the adjacent opposite ends of the hollow formations of the header, stiles and base, to form and maintain the miter joints at the corners of the frame. Each support and connector member has a pair of legs arranged perpendicular one another and of cross-sectional configuration complementary to that of the hollow formation of the header, base and stiles to enable engagement of the legs therein. In the preferred embodiment, the support and connector members are mechanically fastened to the framing members, such as by screws or other suitable fasteners.

Each support and connector member installed internally of the joint between the header and stiles includes latch means having a latch bolt extending through one of said passageways. The latch bolt is engageable with a guide rail of the master frame jamb, and is linearly movable for release from the guide rail from the exterior of the header selectively for pivoting of the sash.

Each support and connector member installed internally of the joint between the base and stiles includes a pivot pin extending through the other of said passageways. The pivot pin is engageable with the sash balance mechanism rotatable member for pivotal movement of the sash when the latch means bolt is released.

Each support and connector member is installed in a close, complementary fit with the conjoined sash frame members to achieve a tight miter joint which prevents leakage of light through the miter joint from either of the opposite surfaces of the conjoined frame members.

BRIEF DESCRIPTION OF THE DRAWING

FIG. 4 is an exploded perspective view of the miter joint between the header and a stile and showing a support and connector member with latch means;

FIG. 5 is a side elevational view of the actuating slider shown in FIG. 4;

FIG. 6 is a bottom view of the actuating slider;

FIG. 7 is an end view of the actuating slider;

FIG. 16 is an exploded perspective view of the miter joint between a stile and the base and showing a support and connector member with pivot pin means;

FIG. 17 is a sectional view of the support and connector member taken along the line 17—17 of FIG. 16 and in the direction indicated by the arrows;

FIG. 18 is a sectional view of the support and connector member taken along the line 18—18 of FIG. 17 and in the direction indicated by the arrows;

FIG. 19 is a top view of a locking actuating member installed above the header;

FIG. 20 is a sectional view of a miter joint between a header and a stile taken along the line 20—20 of FIG. 19 and in the direction indicated by the arrows, illustrating an alternate embodiment of the support and connector member with latch means;

FIG. 21 is a sectional view of the header, alternate embodiment support and connector member latch bolt and locking slider taken along the line 21—21 of FIG. 20 and in the direction indicated by the arrows;

FIG. 22 is a perspective view of a key used with the locking slider;

FIG. 23 is a plan view of a left-hand support and connector member showing the latch bolt in fragmentary plan view;

FIG. 24 is a plan view of a right-hand support and connector member showing the latch bolt in fragmentary plan view; and FIG. 25 is a sectional view of the stile taken along the line 25—25 of FIG. 3 and in the direction indicated by the arrows.

DESCRIPTION OF THE PREFERRED EMBODIMENT

Figure 1:
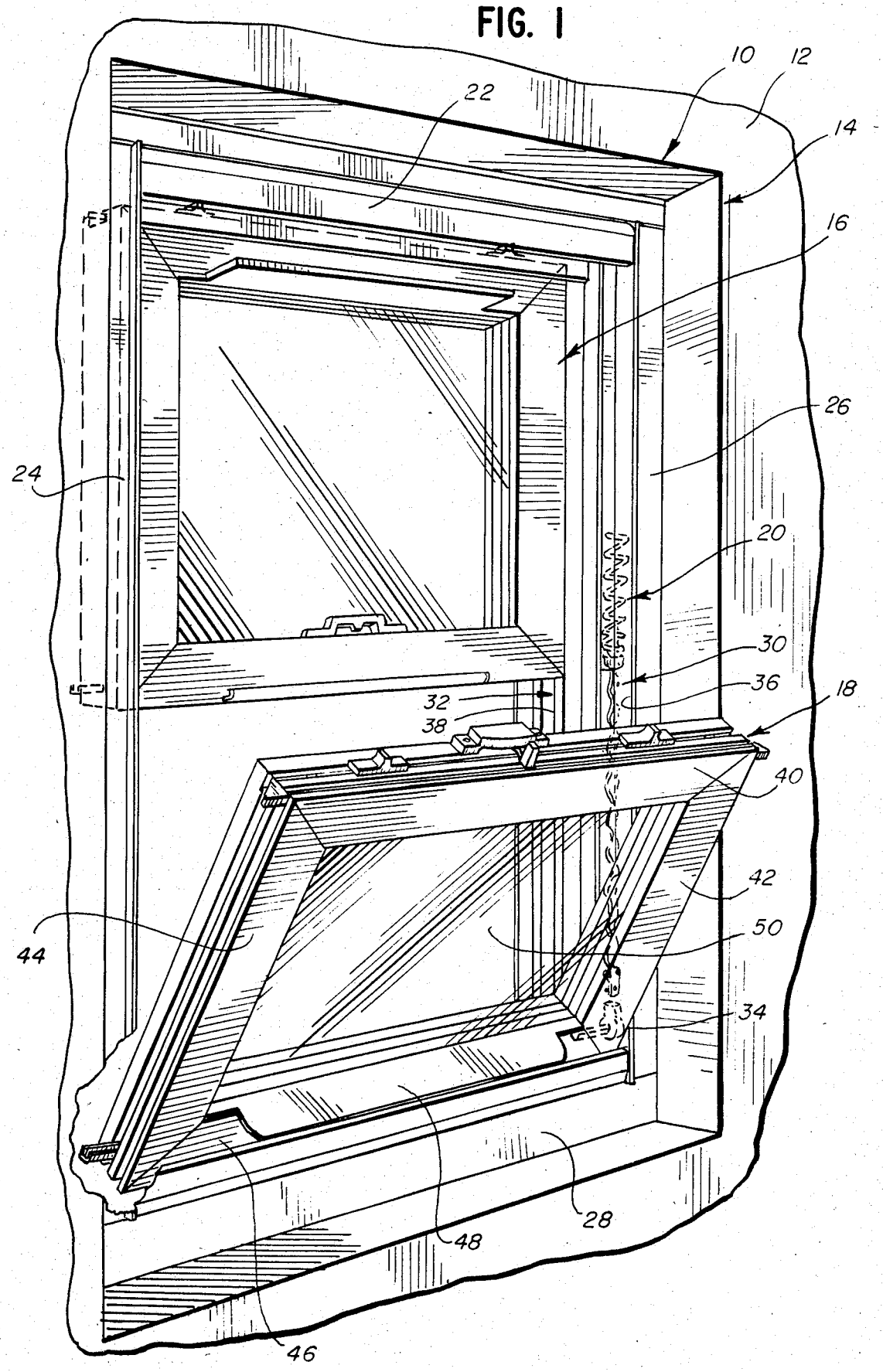
FIG. 1 is a perspective view of a double-hung window assembly mounted in a wall and constructed and arranged for pivoting of the sashes inwardly, the sashes including the latch and pivotal pin support and connector means embodying the invention.

Referring to FIG. 1, a double-hung window assembly incorporating the invention is indicated generally by the reference numeral 10. Assembly 10 is installed in wall 12 and comprises a master frame 14, two glazed sashes 16 and 18 and four sash balance mechanisms 20 of the torsion band type, only one of which is shown.

Master frame 14 comprises a top header 22, two side jambs 24 and 26 and a bottom sill 28. Header 22, jambs 24 and 26 and sill 28 are extruded of plastic material and joined together at their four corners to form a rectangular, i.e. four sides and four right-angled corners, master frame suitable for direct installation in wall 12. Jambs 24 and 26 are cut from extrusions having one cross-sectional configuration while header 22 and sill 28 are cut from extrusions each having its own cross-sectional configurations, as desired for the particular master frame 14.

Jamb 26 has a configuration presenting two parallel and vertically extending channels 30 and 32 in which are operatively mounted the sash balance mechanisms 20 (only one shown). The mechanism 20 in channel 30 operates to balance the inner lower sash 18 while the mechanism that would be mounted in channel 32 would operate to balance outer upper sash 16. The mechanism 20 has a lower rotatable member 34 for connection with the sash 18. Such mechanisms 20 and their operative mounting are known. Jamb 24 presents like vertical channels (not shown) which operatively mounts two additional sash balance mechanisms (not shown).

The channels 30 and 32 in jamb 26 and jamb 24 have interior edges that form vertically extending guide rails 36 and 38 that can be used to maintain the sashes vertically aligned for normal reciprocal movement in master frame 14. Rail 36 of jamb 24 is shown in a broken outline in FIG. 2.

Figure 2:
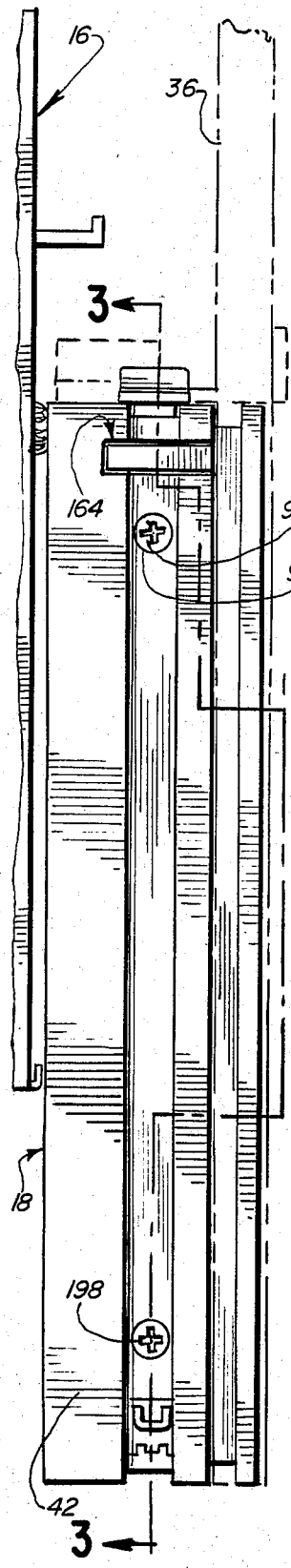
FIG. 2 is left side elevation view of the lower sash of the assembly of FIG. 1 with the upper sash shown in fragmentary side elevation.
Figure 3:
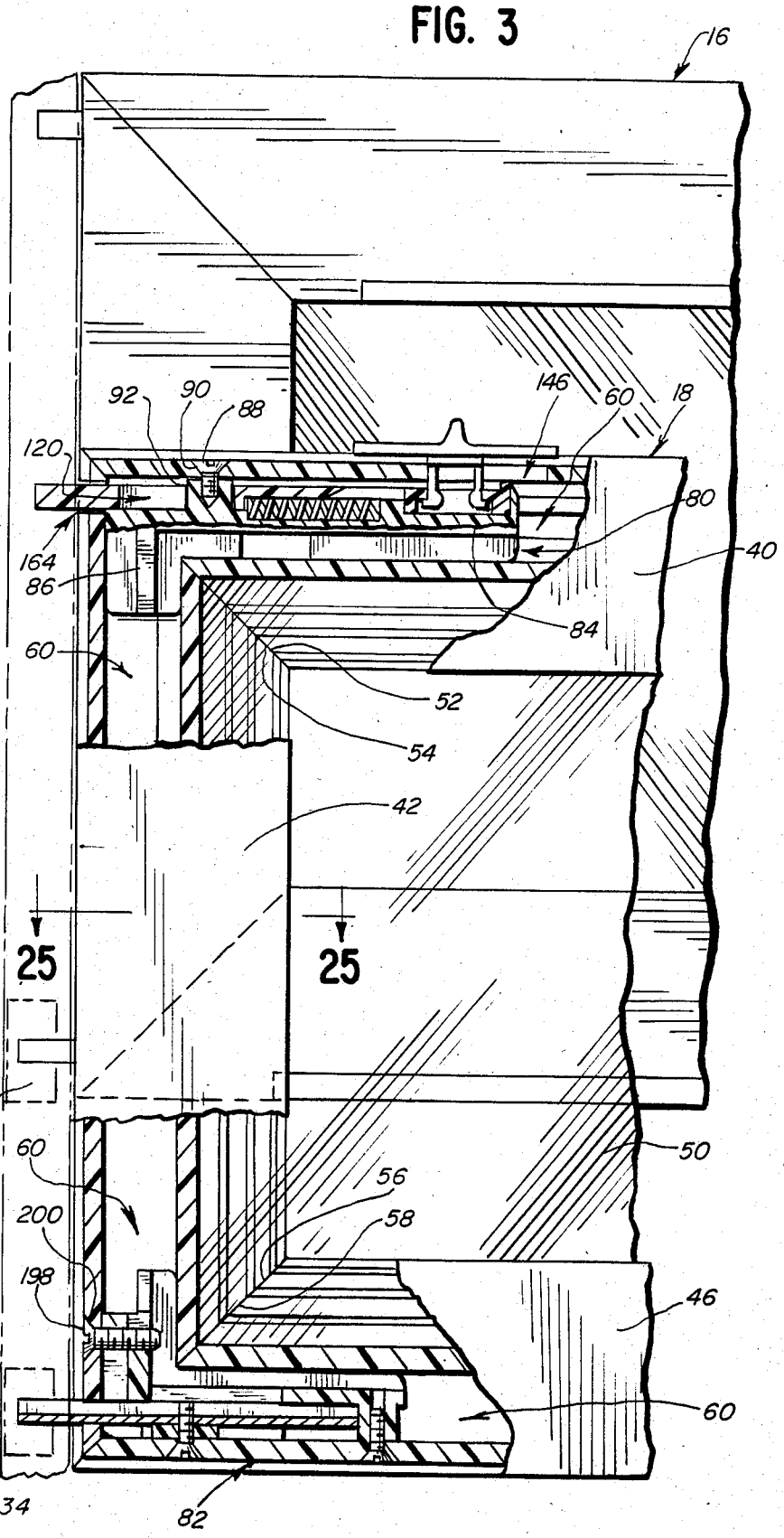
FIG. 3, is a sectional view taken along the line 3—3 of FIG. 2 and in the direction indicated by the arrows.

Referring to FIGS. 2 and 3, sashes 16 and 18 are of like construction and arrangement, and although they may differ in size, such as width, describing one is sufficient for describing the other. Sash 18 is generally rectangular but can be a square, if desired. Sash 18 comprises a top header 40, two side stiles 42 and 44, a base 46 having a handle 48, and glazing 50.

The header 40, base 46 and stiles 42 and 44 are extruded from a suitable synthetic plastic to have a uniform cross-sectional configuration along their lengths defined by a hollow configuration opening to the ends or extremities thereof. In practice, an extruded length of desired cross-sectional configuration is cut into desired lengths forming the header 40, base 46 and stiles 42 and 44. The ends of the header 40, base 46 and stiles 42 and 44 are mitered for cooperatively abutting or connection together in miter joints at adjacent extremities thereof to form the rectangular frame of the sash.

In particular, the end surface 52 of header 40 is mitered at about a 45 degree angle to abut flush with one mitered end surface 54 of stile 42. The other end surface 56 of stile likewise is mitered at about a 45 degree angle to abut flush with the mitered end surface 58 of base 46. The four corners of the sash frame, thus, are defined by miter joints. Theoretically, these miter joints are light proof by true flush abutting of perfectly cut end surfaces and properly configured extrusions. In reality, the extrusion from which the header, base and stiles are cut, is warped and wavy and the miter cuts are imperfect, resulting in voids between the supposedly abutting surfaces of the miter joint thereby allowing light to pass through the sash, as was discussed earlier.

Since the two miter joints at the left-hand side of sash 18 are mirror-image duplicates of those at the right-hand of the sash, a description of the two left-hand miter joints will be sufficient to describe all of the sash miter joints In FIG. 25, the cross-sectional configuration of stile 42 comprises a hollow formation 60 surrounded by an outer wall 62, side walls 64 and 66 and an inner wall 68. Two inwardly extending box-like sections 70 and 72 define a channel 74 receiving the peripheral margin of the glazing. This cross-sectional configuration is used for all of the header 40, base 46 and both stiles 42 and 44.

The problems of the prior miter jointed, extruded plastic member, fabricated sashes are overcome and stronger, simplier sashes are achieved by the provision of support and connector members 80 and 82, respectively installed internal of the header 40 and stile 42, at the miter joint therebetween, and internal of the stile 42 and base 46, at the miter joint therebetween. Members 80 and 82 are molded of plastic material.

Referring also to FIG. 4, member 80 is "L" shaped and has two leg segments 84 and 86 arranged perpendicular to one another. The cross-sectional configurations of the leg segments 84 and 86 are complementary to the hollow formations 60 of the header 40 and stile 42 for compatible and snug engagement therein. Thus, operatively engaged, leg segment 84 is completely internal hollow formation 60 of header 40, and leg segment 86 is completely internal hollow formation 60 of stile 42. Member 80 and header 40 are rigidly joined together by any fastener, such as a screw 88 passing through opening 90 in the outer wall of header 40 and into a screw post 92 upstanding from a platform 94 of leg segment 84. Member 80 and stile 42 are rigidly joined together by any fastener, such as screw 96 (FIG. 2) passing through opening 98 in the outer wall of stile 42 and into threaded engagement with "U"-shaped screw flange 100 and a margin of platform 94 depending along leg segment 86. Member 80 includes upstanding rigidifying flanges 104 and depending rigidifying flanges 106 extending along the opposed longitudinal margins of the leg segments 84 and 86 so that the miter joint formed with support and connector member 80 is strong, fixed and light blocking.

Fabrication of the miter joint occurs by simply inserting the leg segments 84,86 of member 80 in the hollow formations 60 of the header 40 and stile 42, and fastening the parts together with two self-tapping screws 88 and 96. No jig or glue is needed and there is no time spent waiting for glue to set.

Beyond simplifying the construction of and rigidifying the miter joint between header 40 and stile 42, support and connector member 80 includes a latch means that engages with one of guide rails 36 for maintaining sash 18 vertically aligned in master frame 14. Latch means 110 (FIG. 4) comprises a latch bolt 112, a spring 114, an actuating slider 116, and cooperating structure of member 80.

Latch bolt 112 is molded of plastic material to be plate-like and is dimensioned to be received in a channel 118 formed by platform 94 and upstanding and rigidifying flanges 104 for longitudinal reciprocal movement therein. Bolt 112 is retained in channel 118 by the inwardly extending lips 121 of opposed retaining flanges 123. Flanges 123 are formed for slight outward flexure thereof with lips 121 normally spaced from one another a distance just less than the width of bolt 112. Thus, after installation in channel 118, bolt 112 is retained vertically by lips 121 and platform 94 and horizontally by flanges 104. Bolt 112 includes a longitudinal slot 120 therein having a width accommodating screw post 92 and a length longer than that of post 92. Bolt 112 installed in channel 118, encompasses post 92 and is longitudinally slidable in channel 118 with screw post 92 acting as a stop limiting the longitudinal reciprocal movement of the bolt 112.

Figure 12:
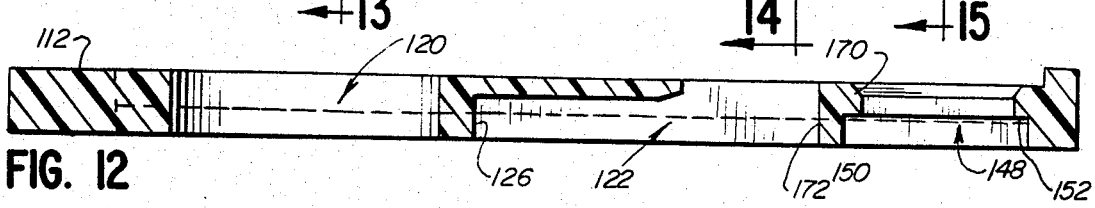
FIG. 12 is a side sectional view of the latch bolt taken along the line 12—12 of FIG. 11 and in the direction indicated by the arrows.
Figure 13:
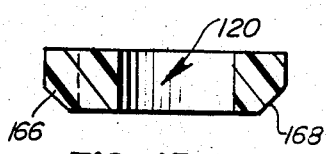
FIG. 13 is a sectional view of the latch bolt taken along the line 13—13 of FIG. 11 and in the direction indicated by the arrows.
Figure 14:
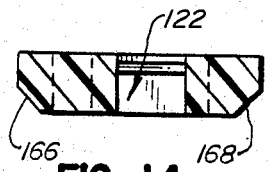
FIG. 14 is a sectional view of the latch bolt taken along the line 14—14 of FIG. 11 and in the direction indicated by the arrows.
Figure 15:
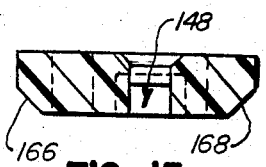
FIG. 15 is a sectional view of the latch bolt taken along the line 15—15 of FIG. 11 and in the direction indicated by the arrows.

Spring 114, a wire wound compression type, operatively mounts in a lower groove 122 of bolt 112, best seen in FIG. 12. One end 124 of spring 114 abuts against a face 126 of groove 122 while the other end 128 of spring 114 abuts against the surface 130 of spring post 132. Platform 94 includes an upwardly facing groove 134, see FIGS. 8 and 10, for proper seating and operation of spring 114. In operation, spring 114 maintains bolt 112 positively biased in its extended position.

Slider 116 is molded to have a plate-like base 136 and two depending fingers 138 and 140 terminating in outwardly extending and upward facing lips 142, 144, see FIGS. 5–7, arranged transverse of the base. Slider 116 operatively mounts with fingers 138 and 140 passing through passageway 146 cut through the outer wall of header 40 and into aligned engagement interior of a slot 148 in bolt 112. Referring specially to FIGS. 5 and 12, fingers 138 and 140 and slot 148 are dimensioned so that lip 142 is biased under surface 150 of slot 148 and so that lip 144 is biased under surface 152 of slot 148. So biased by the outward, elastic flexure of fingers 138 and 140, the slider is engaged and retained in bolt 112 for effecting reciprocal movement of bolt 112 under action of forces applied to finger flange 154 of slider 116. Effecting a reciprocal movement of slider 116, thus, effects a reciprocal movement of bolt 112 for retracting same from engagement with one of said master frame jamb guide rails 36, with spring 114 acting to return bolt 112 to its extended normal position.

Figure 8:
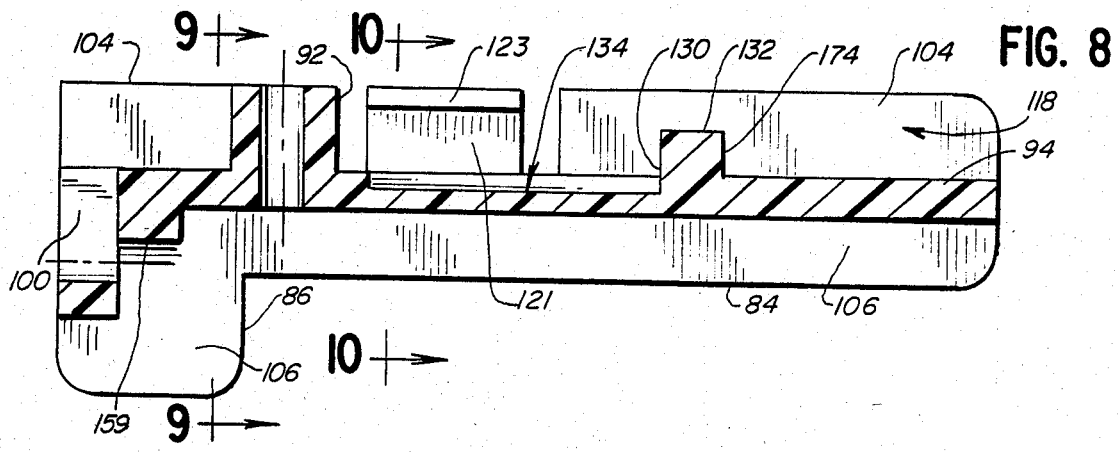
FIG. 8 is a median side sectional view of the support and connector member shown in FIG. 4.
Figure 9:
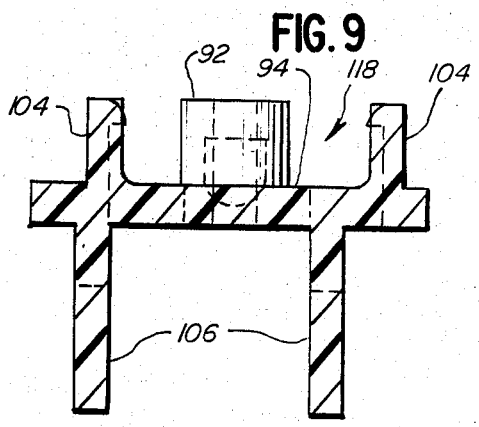
FIG. 9 is a sectional view of the support and connector member taken along the line 9—9 of FIG. 8 and in the direction indicated by the arrows.
Figure 10:
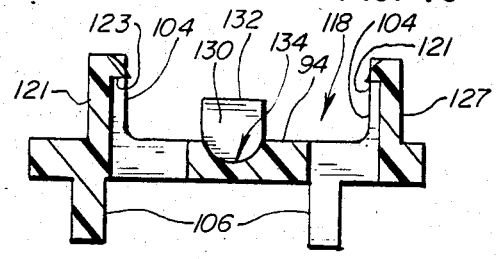
FIG. 10 is a sectional view of the support and connector member taken along the line 10—10 of FIG. 8 and in the direction indicated by the arrows.
Figure 11:
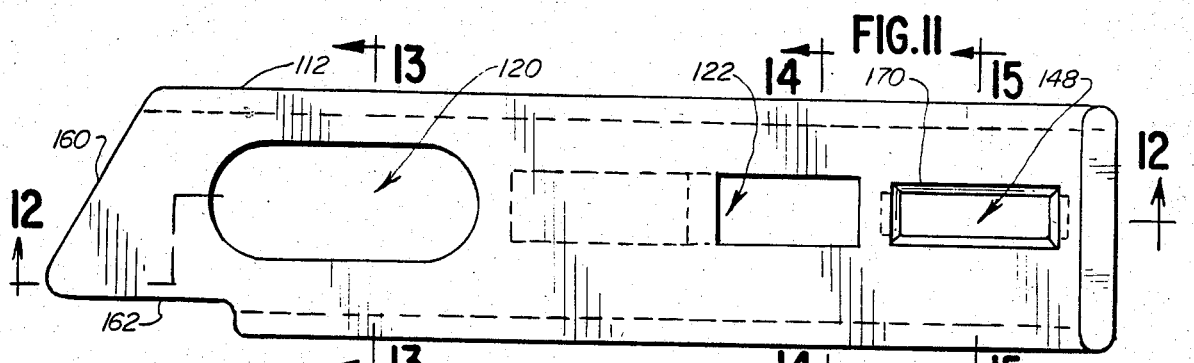
FIG. 11 is a plan view of the latch bolt shown in FIG. 4.

Referring to FIGS. 8, 9 and 10 the support and connector member 80 is shown in more detail and the margin of platform 94 depending along leg segment 86, for receiving the threads of screw 96, is indicated by reference numeral 159. The platform 94 and rigidifying flanges 104 and 106 serve to resist forces acting to change the right angle disposition of the legs.

Referring to FIGS. 11–15, latch bolt 112 presents a beveled camming surface 160 and a longitudinally aligned latching surface 162. Both of surfaces 160 and 162 normally extend through and outwardly from a passageway 164 (see FIGS. 2, 3 and 4) cut through the outer wall of stile 42 near or contiguous the end thereof and aligned with bolt 112 when the joint between the header 40 and stile 42 is formed. Latching surface 162 is intended for engagement with one of the guide rails 36. Camming surface 160 is intended for engagement with jamb 26 to move bolt 112 inwardly for automatic latching of the sash when the sash is being returned to the vertical position. The two lower, outer margins 166 and 168, extending along the length of bolt 112, are beveled for aiding installation of the bolt in channel 118. The upper perimeter 170 of slot 148 is beveled for aid in installation of slider fingers 138 and 140 therein. Alternatively, with post 92 acting as a stop in slot 120, or cooperatively therewith, the surface 172 of spring slot 122 opposite face 126, can act as a stop against the spring post surface 174 to limit extension of the bolt from stile 42.

Referring to FIGS. 16, 17 and 18, support and connector member 82 is "L"-shaped and has two leg segments 180 and 182 arranged perpendicular to one another. The cross-sectional configurations of leg segments 180 and 182 are complementary to the hollow formations 60 of base 46 and stile 42 for compatible and snug engagement therein. Thus, operatively engaged, leg segment 180 is completely internal hollow formation 60 of base 46 and leg segment 182 is completely internal hollow formation 60 of stile 42. Member 82 and base 46 are rigidly joined together by any fastener, such as self-tapping screws 184 and 186 passing through openings 188 and 190 in the outer wall of base 46 and into engagement in member 82 screw post 192 and the opening 194 in bridging portion 196. Member 82 and stile 42 are rigidly joined together by any fastener, such as self tapping screw 198, FIGS. 2 and 3, passing through opening 200 in the outer wall of stile 42 and into engagement with the "U"-shaped screw flange 202 and a margin 204 of platform 206 extending along both legs 180, 182 of member 82. Member 82 includes an opposed pair of upstanding rigidifying flanges 208 longitudinally extending along the margins of platform 206, and an opposed pair of depending rigidifying flanges 210 longitudinally extending centrally along platform 206 and terminating in screw flange 202. Bridging portion 196 extends between flanges 210 and is spaced from platform 206. Thus configured, member 82 presents a passageway 212 defined by platform 206, flanges 210 and bridging portion 196 extending along leg segment 180 and terminating at screw post 192 depending from platform 206.

Fabrication of the miter joint between stile 42 and base 46 occurs by simple insertion of the leg segments 180 and 182 into the hollow formations 60 of the base 46 and stile 42, and fastening of the parts together with only the screws 184 and 198. Screw 186 has a purpose to be explained presently.

Beyond simplifying the construction of and rigidifying the miter joint between base 46 and stile 42, support and connector member 82 includes a pivot means that engages with rotatable member 34 of the balance mechanism 20 for establishing a pivot axis around which the sash 18 can be inwardly pivoted, tilted or rotated. Referring to FIGS. 16, 17 and 18, pivot means 214 comprises a pivot pin 216 cooperating with the previously described passageway 212 and screw post 192 of member 82. Pivot pin 216 is formed of such as a strip of sheet metal bent into a channel formation and drilled to provide a locating opening 218 arranged closer to one end 220 of pin 216 than the other.

Stile 42 includes a notch or passageway 222 cut through the outer wall thereof and near or contiguous the end thereof for alignment with passageway 212 when the miter joint between the base 46 and stile 42 is formed. Pin 216 is installed into passageway 212 with end 220 first and is slipped thereinto until end 220 abuts screw post 192. Screw 186 then is installed through base opening 190, bridging portion opening 194 and pivot pin opening 218 to fix the pivot pin 216 in the passageway 212, screw 186 operating as a locating pin preventing longitudinal movement of the pin 216. In this position, pivot pin 216 extends out through passageway 222 in stile 42 and therefrom a proper distance for engagement with rotatable member 34 but otherwise to clear the jamb 24, see FIG. 3.

Note that screw post 192 has cooperated with pivot pin 216 so that pivot pin 216 extends a proper, selected distance from the outer wall of stile 42 for proper operation of the window assembly, and also, so that opening 218 in pin 216 is properly aligned with openings 194 and 190 for the otherwise blind installation of locating screw 186. Opening 218 in pin 216 need not be threaded for engagement with the threads of screw 186. It is only important that the shank of screw 186 cooperate with opening 218 for locating the pin 216 to fix the pin's longitudinal position in passageway 212.

While only the miter joints occuring at the left-hand side of sash 18 have been described in detail, the support and connector members, latch means and pivot means so described are duplicated in mirror image at the right-hand miter joints of sash 18. Further, the invention applied to the miter joints of sash 18 is duplicated for sash 16.

The invention thus described by way of the preferred embodiment presents support and connector members internal of the sash frame members for supporting and connecting the members together. Further, latch means for maintaining the sash vertically and pivot means for locating properly the pivot pin for rotation of the sash around a pivot axis are provided cooperating with the structure of the support and connector members. Thus, the support and connector members are integral portions of the latch and pivot means.

Referring to FIGS. 19, 20, 21 and 22, an alternate embodiment of the invention provides a molded plastic support and connector member 230 constructed similar to members 80 and 82 and installed in the hollow formations 232 of a header 234 and a stile 236 both having the cross-sectional configuration illustrated in FIG. 21, which is different from that shown in FIG. 25 for the stile 42. Both cross-sectional configurations effect like results of inner, outer and side walls and hollow formations.

Member 230 effects the same functions of supporting and connecting the miter joint between the header and stile effected by members 80 and 82. Member 230 has a cross-sectional configuration compatible with the hollow formations 232 of the header 234 and stile 236 and is installed therein. Member 230 and header 234 are fastened together by such as a self-threading screw 238 passing through an opening 240 in the header 234 and engaging interior of a screw post 242. Member 230 and stile are like-wise fastned together by means not shown, but similar to that of the preferred embodiment.

Additional to support member 230 rigidifying and joining header 234 and stile 236, member 230 includes locking latch means 244 for the same functions as latching means 110. Locking latch means 244 comprises a latch bolt 246, a spring 248 and a locking slider 250 cooperatively arranged with member 230. Bolt 246, similar to bolt 112 is mounted for reciprocal longitudinal movement on a platform 252 between upstanding rigidifying flanges 254, see FIG. 21. Spring 248, a wire wound compressive type, mounts in a slot 256 molded in the lower surface of bolt 246. One end of spring 248 abuts the face 258 of slot 256 while the other end of spring 248 abuts a spring post 260 upstanding from member platform 252. Reciprocal movement of bolt 246 is limited by screw post 242 abutting the ends of an elongate longitudinal slot 262 in bolt 246. Spring 248 maintains the bolt 246 in its normal extended position.

Bolt 246 includes a latch surface 264 and a camming surface 266 normally extending through a passageway 268 in stile 236 contiguous the top end thereof and aligned with bolt 246. Surfaces 264 an 266 provide the same operative functions as surfaces 162 and 160 of latch bolt 112.

Locking slider 250 is molded and has two fingers 270 and 272 depending from a base 274 and an upstanding finger flange 276 and lock means 278. Fingers 270 and 272 terminate in outwardly and upwardly facing lips, such as lip 280 on finger 272, extending longitudinally of slider 250. Slider 250 is attached to latch bolt 246 by the fingers 270 and 272 being inserted into longitudinal slots in latch bolt 246, such as slot 282 receiving finger 270, with the lips, such as 280 engaging with an interior surface thereof. Thus positioned, slider 250 is positively engaged in latch bolt 246 and a longitudinal force exerted on finger flange 276 and locking means 278 operates to release the latch means. With fingers 270 and 272 operatively engaged with bolt 246, slider base 274 is positioned above the outer wall of header 234 and fingers 270 and 272 pass through a passageway 284 in the outer wall of the header.

Locking means 278 includes a lock bolt 286, in the form of a threaded member having a depending stem 288, arranged for vertical translational movement in circular lock flange 290, which is internally threaded. The top surface of bolt 286 includes a key way 292 formed therein for receiving the mating blade 294 extending from the body of a hand-operated key 296, FIG. 22. In the position illustrated, stem 288 clears the outer wall of header 234 enabling releasing of the latch means for pivoting the sash inwardly.

Engaging key blade 294 in keyward 292 and rotating bolt 286 for downwards translational movement positions stem 288 in passageway 284 for interference (not shown) with the outer wall of header 234. Stem 288 thus located prevents the movement of latch bolt 246 for releasing the latch from the jamb and pivoting of the window sash. The keyway 292 and key blade 294 shown are oval-shaped in cross-section but can be any mating configuration desired. Key 296 typically is controlled by such as building maintenance men to prevent unauthorized tilting of the sashes.

Referring to FIGS. 23 and 24, the support and connector member 80, used in the left-hand miter joint of the header and stile, has the upstanding flanges 104 arranged closer to the margin 300 than to the margin 302. The screw post 92, spring groove 134 and spring post 132 are centrally located median of the margins 300 and 302. This arrangement keys the member 80 for compatible usage only at the top, left-hand miter joint of a sash so that the latch and camming surfaces 162 and 160 always are properly oriented in the sash.

In FIG. 24, support and connector member 304, which is a mirror image of member 80 and for which like reference numerals indicate like structure, also has upstanding flanges 104 arranged closer to margin 300 than to the margin 302. The screw post, 92, spring groove 134 and spring post 132 again are centrally located median of the margins 300 and 302. This arrangement keys the member 304 for compatible usage only at the top, right-hand miter joint of a sash so that the latch and camming surfaces 162 and 160 always are properly oriented in the sash.

The left- and right-hand support and connector members with pivot means need not be arranged to be compatible only at the left- and right-hand miter joints of the stiles and base because they do not include specialized structure, such as the latch surfaces, that must be oriented in only one direction for proper operation.

The invention thus described provides support and connector members that include latch means and pivot means enclosed within the hollows of the extruded sash framing members. The invention facilitates fabrication of the sash frame while rigidifying the same. The number of parts of the latch means is reduced by the elimination of the cover plate and assembly is simplified. Locating the pivot pin properly occurs simply.

Alternatives to the embodiments shown are possible and numerous. The cross-sectional configurations of the header, stiles and base can be as desired with the cross-sectional configuration of the support and connector members including latch and pivot means arranged to be compatible therewith. The configurations of the latch means parts can be varied to present, such as, varying location of the screw post stop, spring, spring post and slider connection with the latch bolt. The pivot means and support and connection member can be varied to modify the pivot pin passageway and use the locating pin screw to fasten the pivot pin in a channel. All of these alternatives and others are encompassed within the invention as described.

The materials of the support and connector members can be varied as desired. In one embodiment the support and connector members, latch bolt, and slider and molded from a polycarbonate material while in another embodiment they are molded from a 40% glass-filled nylon material.

Modifications and variations of the present invention thus are possible in light of the above teachings. It is therefore to be understood that within the scope of the appended claims, the invention may be practiced otherwise than as specifically described.

I claim:

1. A window sash adapted for installation in the frame of a double-hung window assembly, the window assembly frame having opposed, vertically extending guide rails to enable vertical reciprocal sliding movement of the sash in the window assembly frame while cooperatively engaged with the guide rails and a sash balance mechanism to enable pivotal movement of the sash relative to the assembly frame while cooperatively engaged with the sash balance mechanism, said window sash comprising:

1. a sash frame having a header, a base and a pair of stiles cooperatively connected at adjacent extremeties thereof to form a rectangular frame, A. each of said header, base and stiles being extruded to a cross-sectional configuration from a plastic material;

B. said cross-sectional configuration being defined by a continuous hollow formation therethrough opening to opposite ends thereof, said ends being mitered in their configuration; and C. each stile having a passageway through a wall thereof contiguous each end thereof and opening outwardly of said sash;

2. a plurality of combination support and connector members each having a pair of leg segments arranged perpendicular to one another and of cross-sectional configuration complementary to that of the header, base and stiles selected to enable engagement of each leg segment in the hollow formation of said header, base and stiles through adjacent opposite ends thereof to form and maintain miter-joints at the corners of the sash frame;

A. each of said support and connector members including a platform extending along both legs;

3. each of said support and connector members that are installed internally of the pair of mitered corner joints of the header and stiles, including internal latch means having a latch bolt extending through one of said passageways and adapted to engage with one of said guide rails, and means operable from external said header for releasing said latch means selectively to facilitate pivoting of the sash;

A. each of said support and connector members that are installed internally of the pair of mitered corner joints of the header and stiles, including a pair of upstanding flanges longitudinally along the associated platform, said flanges being laterally spaced and defining, with the platform, a channel receiving said latch bolt therein, each of said upstanding flanges being continuous at the conjoinder of the leg segments;

4. each of said combination support and connector members that are installed internally of the pair of mitered corner joints of the base and stiles, including internal pivot means having a pivot pin extending through the other one of said passageways of the stile and adapted for operable engagement with the sash balance mechanism to facilitate pivotal movement by the sash when the latch means is released; and A. each of said combination support and connector members that are installed internally of the pair of mitered corner joints of the base and stiles, including a pair of depending flanges longitudinally along the corresponding platform, said depending flanges being laterally spaced and defining, with the corresponding platform, a passageway receiving said pivot pin, said depending flanges being continuous at the conjoinder of the associated leg segments.

2. The window sash of claim 1 in which the cross-sectional configuration of each support and connector snugly fits in the hollow formations.

3. The window sash of claim 1 in which each support and connector member is "L"-shaped with the shorter of the two legs to be engaged in a stile.

4. The window sash of claim 1 wherein each of said combination support and connector members includes both upstanding and depending pairs of flanges, each pair of flanges continuous at the conjoinder of the respective stiles and header or base, said pairs of flanges, at said conjoinder, defining light barriers.

5. The window sash of claim 1 including a bridging portion extending between said depending flanges in spaced relation to said platform and further defining the passageway for the pivot pin.

6. The window sash of claim 1 wherein each of said support and connector members that are installed internally of the pair of mitered corner joints of the header and stiles, including a pair of opposed retaining flanges longitudinally aligned with said upstanding flanges and having inwardly extending lips normally spaced apart a distance just less than the width of said latch bolt for engagement with the top longitudinal margins of the latch bolt for retention of the latch bolt in said channel.

7. A window sash adapted for installation in the frame of a double-hung window assembly, the window assembly frame having opposed, vertically extending guide rails to enable vertical reciprocal sliding movement of the sash in the window assembly frame while cooperatively engaged with the guide rails and a sash balance mechanism to enable pivotal movement of the sash relative to the assembly frame while cooperatively engaged with the sash balance mechanism, said window sash comprising:

1. a sash frame having a header, a base and a pair of stiles cooperatively connected at adjacent extremeties thereof to form a rectangular frame, A. each of said header, base and stiles being extruded to a cross-sectional configuration from a plastic material;

B. said cross-sectional configuration being defined by a continuous hollow formation therethrough opening to opposite ends thereof, said ends being mitered in their configuration; and C. each stile having a passageway through a wall thereof contiguous each end thereof and opening outwardly of said sash;

2. a plurality of combination support and connector members each having a pair of leg segments arranged perpendicular to one another and of cross-sectional configuration complementary to that of the header, base and stiles selected to enable engagement of each leg segment in the hollow formation of said header, base and stiles through adjacent opposite ends thereof to form and maintain miter-joints at the corners of the sash frame, 3. each of said support and connector members that are installed internally of the pair of mitered corner joints of the header and stiles, including internal means having a latch bolt extending through one of said passageways and adapted to engage with one of said guide rails, and means operable from external said header for releasing said latch means selectively to facilitate pivoting of the sash;

4. each of said combination support and connector members that are installed internally of the pair of mitered corner joints of the base and stiles, including internal pivot means having a pivot pin extending through the other one of said passageways of the stile and adapted for operable engagement with the sash balance mechanism to facilitate pivotal movement by the sash when the latch means is released;

5. each of said support and connector members including a platform extending along both legs and rigidifying flanges upstanding and depending therefrom, there being a "U"-shaped flange extending along the leg to be engaged in a stile cooperating with a depending margin of said platform for receiving a fastener and the other leg including a fastener post upstanding from the platform for receiving a fastener.

8. The window sash of claim 7 including one fastener passing through the stile and into engagement with the "U"-shaped flange and platform depending margin for fastening the stile and support and connector member together and another fastener passing through one of the header and base and into engagement with the fastener post for fastening same with the support and connector member.

9. The window sash of claim 6 in which said upstanding flanges defining said channel are are arranged closer to one longitudinal margin of the platform than the other longitudinal margin of the platform to key the support and connector member for usage at one of the left- and right-hand miter joints between the header and stiles.

10. The window sash of claim 7 in which the pivot means include a pivot pin passageway that is defined by at least the depending flanges of the other leg being centrally located and that is terminated inwardly by said fastener post, the fastener post being arranged along the platform of the other leg cooperatively to locate the pivot pin for extending from the stile a proper distance.

11. The window sash of claim 10 in which said pivot pin passageway further is defined by a bridging portion extending across the ends of the rigidifying flange.

12. The window sash of claim 11 in which said pivot means include a locating pin extending at least through the pivot pin for maintaining said pivot pin in the proper locating in said pivot pin passageway.

13. The window sash of claim 12 in which said locating pin is a screw.

14. The window sash of claim 7 in which said latch bolt is flat and elongate and is retained in a channel of said latch means defined by said platform and upstanding flanges of the other leg for reciprocal longitudinal movement therein, said latch means further including a spring and an actuating slider, said spring being arranged between said latch bolt and support and connector member for maintaining said latch bolt in an extended position adapted to be engaged with one of said guiderails, and said actuating slider including a finger flange arranged externally of said header and connected to said latch bolt through the header outer wall for moving said latch bolt inwardly from said extended position to release the latch means.

15. The window sash of claim 14 in which said support and connector member includes an opposed pair of retaining flanges longitudinally aligned with said rigidifying flanges and having inwardly extending lips normally spaced apart a distance just less than the width of said latch bolt for engagement with the top longitudinal margins of the latch bolt and retaining the latch bolt in said channel.

16. The window sash of claim 14 in which said latch bolt includes a longitudinal slot cooperatively arranged to receive said fastener post therein with said fastener post limiting reciprocal movement of the latch bolt in said channel.

17. The window sash of claim 14 in which said spring is a compression spring and is arranged between a face of a spring receiving groove in a lower surface of the latch bolt and an opposed face of a spring post upstanding from said platform.

18. The window sash of claim 14 in which said slider includes a base arranged exterior of said header from which said finger flange is upstanding and a pair of fingers depends, said fingers passing through the outer wall of said header and having terminating lips engaging with interior surfaces of at least one slot formed in said latch bolt so that forces applied longitudinally to said finger flange are transmitted to said latch bolt through the fingers.

19. The window sash of claim 18 in which said lips are arranged transverse of said slider and said lips engage with interior surfaces of one slot in said latch bolt.

20. The window sash of claim 18 in which said lips are arranged longitudinally of said slider and said lips each engage with the interior surfaces of respective slots in said latch bolt.

21. The window sash of claim 14 in which said slider includes locking means for preventing longitudinal movement of said slider to release said latch means.

22. The window sash of claim 21 in which said lock means include a depending stem adapted for interference with the outer wall of said header when vertically operated to a locking position.

23. The window sash of claim 22 in which said lock means include a key and socket arrangement of compatible geometric cross-section operatively cooperating to vertically reciprocate said stem.

24. The window sash of claim 23 in which said geometric pattern of the key and socket is oval.

25. In a window sash adapted for installation in the frame of a double-hung window assembly, the window assembly frame having opposed, vertically extending guide rails to enable vertical reciprocal sliding movement of the sash in the window assembly frame while cooperatively engaged with the guide rails and a sash balance mechanism to enable pivotal movement of the sash relative to the assembly frame while cooperatively engaged with the sash balance mechanism, the window sash including a sash frame having a header, a base and a pair of stiles cooperatively connected at adjacent extremities thereof to form a rectangular frame, each of said header, base and stiles being extruded to a cross-sectional configuration from a plastic material, said cross-sectional configuration being defined by a continuous hollow formation therethrough opening to opposite ends thereof, said ends being mitered in their configuration, and each stile having a passageway through a wall thereof contiguous each end thereof and opening outwardly of said sash, the herein invention comprising:

1. a combination support and connector member having a pair of leg segments arranged perpendicular to one another and of cross-sectional configuration complementary to that of the header, base and stiles selected to enable engagement of each leg segment in the hollow formation of a said header, base and stiles through adjacent opposite ends thereof to form and maintain miter-joints at the corners of the sash frame;
2. said support and connector member adapted to be installed internally of a mitered corner joint to secure and maintain said joint; and
3. said member constructed and arranged to mount either internal latch means operable from external of the header for releasing said latch means from the guide rails selectively to facilitate pivoting of the sash, or internal pivot means adapted to operably engage a said sash balance mechanism for facilitating pivotal movement of the sash when the latch means is released; and 4. said support and connector member including a platform extending along both legs, and a pair of laterally spaced flanges longitudinally along said platform, said flanges and said platform defining a channel alignable with a passageway in an adjoining stile for confining and retaining reception of an operating component of said internal latch means or said internal pivot means;

5. the support and connector member which mounts said pivot means, wherein the operating component of said pivot means includes a pin adapted to extend through a said passageway into engagement with a sash balance mechanism, the channel confining the operating component of the pivot means being terminated inwardly by a fastener post, the fastener post being arranged along the platform of the one leg cooperatively to locate the pivot pin for extension from the stile a proper distance.

26. The combination support and connector member of claim 22 in which said latch means will include a slidable latch bolt adapted to extend through one of said passageways for engagement with a guide rail, said latch bolt is flat and elongate and is retained in a channel of said latch means defined by a platform and flanges upstanding therefrom of one leg for reciprocal longitudinal movement therein, said latch means further including a spring and an actuating slider, said spring being arranged between said latch bolt and a leg segment for maintaining said latch bolt in an extended position adapted to be engaged with one of said guide-rails, and said actuating slider including a finger flange arranged externally of said header and connected to said latch bolt through the header outer wall for moving said latch bolt inwardly from said extended position to release the latch means.

27. The window sash of claim 25 wherein each of said combination support and connector members includes both upstanding and depending pairs of flanges, each pair of flanges continuous at the conjoinder of the respective stiles and header or base, said pairs of flanges, at said conjoinder, defining light barriers.

28. The Window sash of claim 25 wherein each channel includes a fastener-receiving component projecting from said platform for the reception of an anchoring fastener, said fastener-receiving component defining the longitudinal position of the corresponding operating component.

29. The window sash of claim 28 including driven fasteners engageable through said sash frame and into said fastener-receiving components.

30. The window sash of claim 29 wherein the operating component of said latch means includes an elongate latch bolt, said latch bolt including a longitudinal slot receiving said fastener-receiving component therein, said fastener-receiving component limiting reciprocal movement of the latch bolt in the corresponding channel.

31. In a window sash adapted for installation in the frame of a double-hung window assembly, the window assembly frame having opposed, vertically extending guide rails to enable vertical reciprocal sliding movement of the sash in the window assembly frame while cooperatively engaged with the guide rails and a sash balance mechanism to enable pivotal movement of the sash relative to the assembly frame while cooperatively engaged with the sash balance mechanism, the window sash including a sash frame having a header, a base and a pair of stiles cooperatively connected at adjacent extremities thereof to form a rectangular frame, each of said header, base and stiles being extruded to a cross-sectional configuration from a plastic material, said cross-sectional configuration being defined by a continuous hollow formation therethrough opening to opposite ends thereof, said ends being mitered in their configuration, and each stile having a passageway through a wall thereof contiguous each end thereof and opening outwardly of said sash, the herein invention comprising:

1. a combination support and connector member having a pair of leg segments arranged perpendicular to one another and of cross-sectional configuration complementary to that of the header, base and stiles selected to enable engagement of each leg segment in the hollow formation of a said header, base and stiles through adjacent opposite ends thereof to form and maintain miter-joints at the corners of the sash frame,
2. said support and connector member adapted to be installed internally of a mitered corner joint to secure and maintain said joint;
3. said member constructed and arranged to mount either internal latch means operable from external of the header for releasing said latch means from the guide rails selectively to facilitate pivoting of the sash, or internal pivot means adapted to operably engage a said sash balance mechanism for facilitating pivotal movement of the sash when the latch means is released;
4. said pivot means including a pin adapted to extend through a said passageway into engagement with a sash balance mechanism and a pivot pin passageway that is defined by at least a platform and centrally located flanges depending therefrom of one leg segment and that is terminated inwardly by a fastener post, the fastener post being arranged along the platform of the one leg cooperatively to locate the pivot pin for extension from the stile a proper distance.

32. For use in a window sash frame having a header, a base and a pair of stiles; support and connector members for the joining of said header base and stiles in a rectangular frame, each said member having a pair of conjoined leg segments perpendicular to one another for respective reception within one end portion of a stile and in the adjoining end portion of the header or base for a joining thereof, one of said leg segments being receivable in the said stile including fastener receiving and anchoring means, the other of said leg segments including a platform, a fastener-receiving component projecting from said platform for the reception of an anchoring fastener for the support and connector member, a sash mounting element overlying said platform and longitudinally received along the corresponding leg segment, said fastener receiving component defining the longitudinal position of said mounting element, and retaining means on said support and connector member engaging said sash mounting element and retaining said sash mounting element on said platform.

33. A support and connector member in accord with claim 32 further including a longitudinally extending projecting flange on said platform laterally to each side of the sash mounting element, said flanges projecting perpendicular to the platform and extending continuously across the conjoinder of the leg segments.

34. A support and connector member in accord with claim 33 wherein said flanges are both upstanding and depending from said platform.

* * * * *